US007065937B2

(12) United States Patent
Tankersley

(10) Patent No.: US 7,065,937 B2
(45) Date of Patent: Jun. 27, 2006

(54) METHOD OF MANUFACTURING AND FILLING STAND-UP BAGS

(75) Inventor: James I. Tankersley, Bells, TN (US)

(73) Assignee: HB Creative LLC, Bells, TN (US)

( * ) Notice: Subject to any disclaimer, the term of this patent is extended or adjusted under 35 U.S.C. 154(b) by 0 days.

(21) Appl. No.: 10/876,973

(22) Filed: Jun. 24, 2004

(65) Prior Publication Data

US 2004/0226265 A1 Nov. 18, 2004

Related U.S. Application Data

(62) Division of application No. 10/104,413, filed on Mar. 21, 2002, now Pat. No. 6,957,915.

(51) Int. Cl.

| | |
|---|---|
| ***B65B 61/02*** | (2006.01) |
| ***B65B 61/16*** | (2006.01) |
| ***B65B 61/18*** | (2006.01) |
| ***B65B 9/06*** | (2006.01) |

(52) U.S. Cl. ..... 53/411; 53/412; 53/413; 53/451; 53/140; 53/131.5; 53/551; 53/133.8; 53/134.1

(58) Field of Classification Search ..... 53/412, 53/413, 450, 451, 133.3, 133.8, 134.1, 550, 53/551, 552, 411, 140, 131.1, 131.2, 131.4, 53/131.5, 370.2, 370.6, 370.7, 371.3, 373.7, 53/374.3

See application file for complete search history.

(56) References Cited

U.S. PATENT DOCUMENTS

| | | | | |
|---|---|---|---|---|
| 3,555,974 A | | 1/1971 | Davis | |
| 3,642,189 A | | 2/1972 | Widenback | |
| 3,654,841 A | * | 4/1972 | Davis, Jr. | 493/190 |
| 3,663,239 A | | 5/1972 | Rowe | |
| 3,696,179 A | * | 10/1972 | Jacobs | 53/140 |
| 3,935,993 A | | 2/1976 | Doyen | |
| 4,637,199 A | * | 1/1987 | Steck et al. | 53/451 |
| 4,767,482 A | * | 8/1988 | Diez et al. | 156/163 |
| 4,909,356 A | * | 3/1990 | Rimondi et al. | 53/134.1 |
| 5,219,229 A | | 6/1993 | Sengewald | |
| 5,226,269 A | * | 7/1993 | Stoltenberg | 53/450 |
| 5,288,531 A | | 2/1994 | Falla | |
| 5,313,766 A | * | 5/1994 | Rimondi et al. | 53/451 |
| 5,400,569 A | * | 3/1995 | Jones et al. | 53/450 |
| 5,437,406 A | | 8/1995 | Gordon | |
| 5,547,284 A | | 8/1996 | Imer | |
| 5,732,532 A | * | 3/1998 | Fujisaki et al. | 53/451 |
| 5,941,643 A | | 8/1999 | Linkiewicz | |
| 6,182,850 B1 | | 2/2001 | Marbler | |
| 6,352,365 B1 | | 3/2002 | Healy | |
| 6,481,183 B1 | * | 11/2002 | Schmidt | 53/412 |
| 6,500,559 B1 | | 12/2002 | Hofmeister | |
| 6,820,391 B1 | * | 11/2004 | Barmore et al. | 53/133.4 |

FOREIGN PATENT DOCUMENTS

| | | |
|---|---|---|
| WO | WO03080456 | 10/2003 |

* cited by examiner

*Primary Examiner*—Stephen F. Gerrity
(74) *Attorney, Agent, or Firm*—Cooper & Dunham LLP

(57) ABSTRACT

A standup bag for granular products or the like and a method of manufacturing the bag. The standup bag is manufactured from an extruded heat scalable material and includes both an integral handle and a perforation to facilitate opening and pouring out the contents of the bag.

42 Claims, 8 Drawing Sheets

FIG. 3
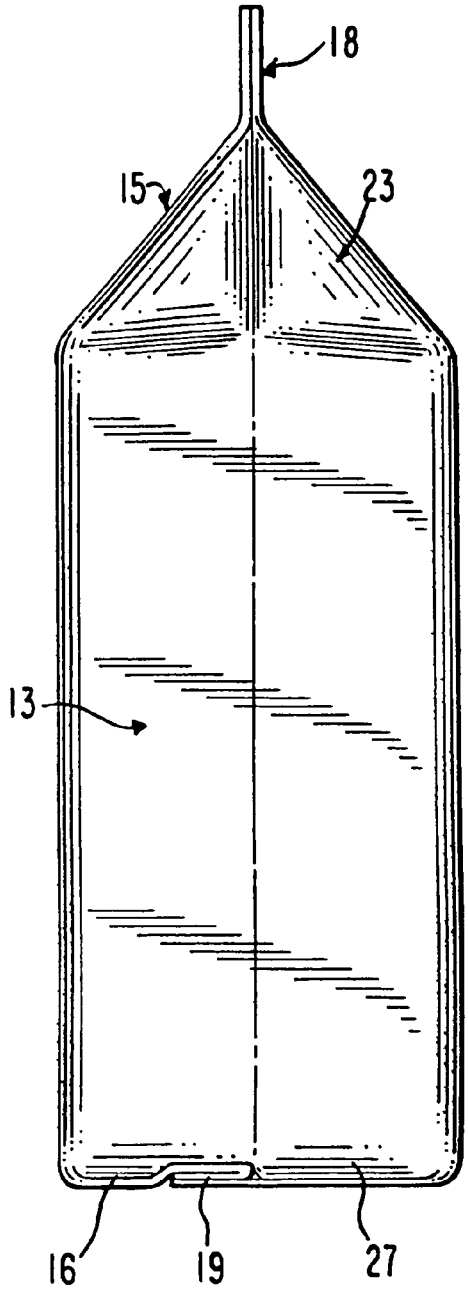
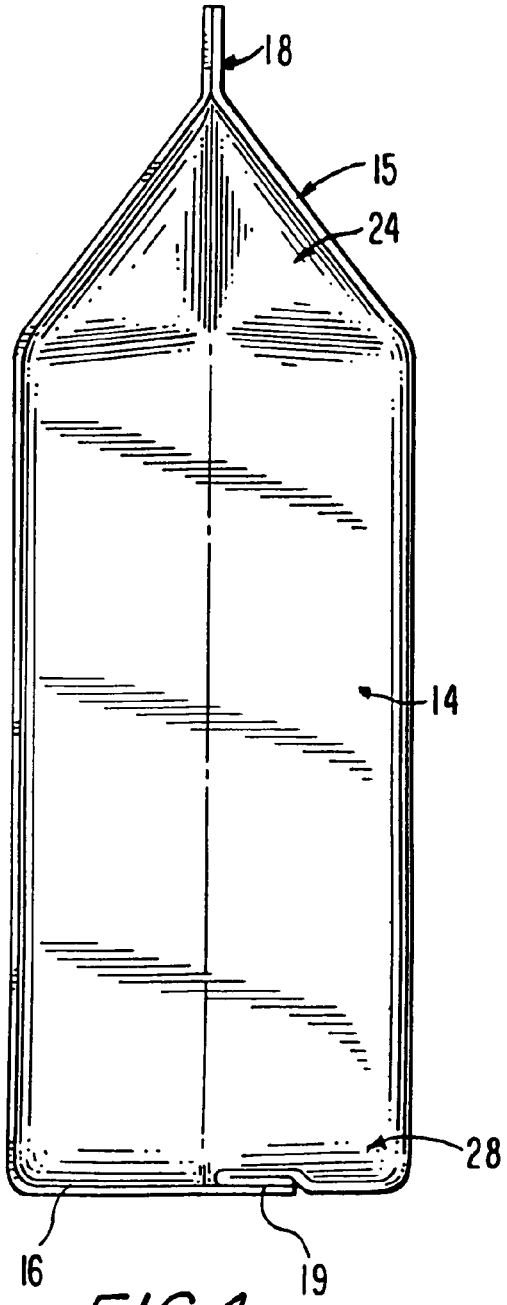
FIG. 4

METHOD OF MANUFACTURING AND FILLING STAND-UP BAGS

This application is a divisional application of U.S. Ser. No. 10/104,413, filed Mar. 21, 2002, which issued as U.S. Pat. No. 6,957,915 on Oct. 25, 2005.

FIELD OF THE INVENTION

This invention relates to a standup bag for granular products or the like with an easy-opening and pouring facility and an integral handle. The standup bag is manufactured from an extruded heat sealable film. This invention also relates to methods of producing the standup bag.

BACKGROUND OF THE INVENTION

For many years, polyethylene pillow-shaped bags have been used for packaging granular products, such as frozen vegetables. These bags must be stacked vertically because they do not stand up. When stacked vertically, it is difficult for a consumer to determine the contents because the principal display panel is concealed.

It is desirable to have bags which stand up so that the principal display panel faces the consumers. Arranging the bags in the standing up position also takes less supermarket shelf space. Stand-up bags for food products in some instances include pouring spouts. For example, U.S. Pat. No. 5,547,284 to Imer shows a stand-up bag having a corner portion which may be cut away to form a spout for pouring. U.S. Pat. No. 5,636,925 to Smiley shows a radially disposed perforation in the upper right hand corner of the bag to provide a pouring spout. In addition, the Smiley patent includes a handle located on top of the bag. U.S. Pat. No. 4,454,979 to Ikeda shows a bag which includes a handle that is cut away to form a spout for pouring. None of the known bags, however, are standup bags manufactured from an extruded heat sealable film which includes both an integral handle and a perforated section that can be torn to open the bag and form a pouring spout.

It is known to manufacture bags from coextruded polyethylene film or laminated film. The manufacturing process includes the step of sealing a bag by applying enough heat to the surface of the bag to melt the material and cause it to adhere to itself.

In order to heat seal bags manufactured from coextruded polyethylene, the packaging industry has developed a heat sealing mechanism that is similar in design to a light bulb filament. This heat seal mechanism generates enough heat to reach the melting point of the material. Only the inside layer needs to melt to create the seal. The remaining outer layers must be cooled so that they do not melt and cause the bag to lose its shape. The mechanism used for cooling may include blasts of cold air following the application of heat. The cooling step increases the time to produce bags manufactured from coextruded polyethylene. Thus, the bags can be produced at a rate of only about 60 bags per minute.

To avoid the manufacturing problems associated with heat sealing coextruded polyethylene, the packaging industry has used laminated film. Laminated film consists of layers of different material which are brought together. The layers may consist of such materials as polyethylene, polyester, paper, foil and polypropylene. The outside layer of laminated film consists of a heat resistant material, such as polyester, or is coated with heat resistant material. In either case, the outside layer melts at a higher temperature than the inside layer. This difference in melting points allows for the continuous application of high temperature jaws or some other suitable mechanism to the outer layer to effectuate a heat seal. The high temperature jaws, which can be set to a temperature higher than the melting point of the inside layer and lower than the melting point of the outer layer, melt the inside layer without melting the outer layer. A heat seal of the inside layer results without structural breakdown of the outer layer and eliminates the need for cooling the outer layer. The use of laminated film and high temperature jaws streamlines the manufacturing process and permits bags to be produced at a rate of about 90 bags per minute. However, the laminated film is approximately three times the cost of coextruded polyethylene.

Therefore, there is a need in the packaging industry to combine the cost advantages of using low cost extruded polyethylene film with the manufacturing advantages of using high temperature jaws in a continuous laminated film line, especially to create a standup bag for food or other granular products.

SUMMARY OF THE INVENTION

It is therefore an object of the present invention to provide a standup bag for granular products having both an integral handle and an easy-opening and pouring facility to deliver the contents of the bag.

It is a further object of the present invention to provide a standup bag manufactured from an extruded, heat sealable film.

It is another object of the present invention to provide a method for producing a standup bag manufactured from a coextruded, multi-layered heat sealable film, which eliminates the need for cooling outer layers after heat sealing the bag.

It is yet another object of the present invention to provide a method for producing a standup bag manufactured from a coextruded multi-layered heat sealable film and having both an integral handle and a perforated section to facilitate opening and pouring out of the contents of the bag.

The foregoing objects are achieved and the disadvantages of the known bag designs are overcome by providing a standup bag in accordance with the present invention. The standup bag includes front and rear walls, two side walls, a top portion and a bottom portion upon which the bag stands when filled.

A single piece of heat sealable film, having top and bottom edges and first and second side edges, is continuously formed into the front wall, the two side walls, and the rear wall. The rear wall is closed by heat sealing the first and second side edges to each other. The top portion is sealed by heat sealing the top edge and the bottom portion is sealed by heat sealing the bottom edge.

The term "walls" is meant to be broad enough to include a bag design resembling a pouch, whereby the rear, top and bottom portions are sealed in the same manner as the above embodiment and the bag can stand up when filled, but the overall structure lacks defined corners or folds.

The heat sealable film preferably is an extruded, blown or cast polyethylene film that can be coextruded from various formulations such as Low Density Polyethylene (LDPE), Linear Low Density Polyethylene (LLDPE), metallocene catalyzed polyolefins, High Density Polyethylene (HDPE), polypropylene, polypropylene co-polymers, polyethylene co-polymers, or blends of the LDPE, LLDPE, metallocene catalyzed polyolefins, HDPE resins, polypropylene, polypropylene co-polymers and polyethylene co-polymers in combination with coatings to yield a multi-layer film. The film can be extruded on a single or multi-layer blown film line.

The object is to produce a film having an inside layer which can be sealed at a lower temperature than outer/exterior layers. More specifically, the inside layer has a lower melting point and, in turn, a lower seal initiation point than the outer layers. The differential in the heat sealing temperature of the inside layer and the outer layers allows for use of continuous heat sealing clamps, jaws or similar heat sealing devices that do not require a cooling medium for the film. Therefore, a bag forming and filling machine with heat sealing devices, such as jaws and clamps, previously used only with laminated film can be used with non-laminated coextruded heat sealable film.

The extruded film can be opaque or clear, and may have no ink or include heat resistant ink or overcoating on its outer layer. Heat resistant ink may be applied in a pattern, leaving no ink between ear sections of a bag, enabling the ear sections to be more readily sealed to each other. The ear sections are portions of the top and bottom edges (approximately ¼ of the length of an edge) running from the right and left side walls of the bag toward the center. As shown in FIGS. 8 and 9, the inside layers of each ear section are sealed, and the outer layers can also be sealed more effectively if no ink has been applied to those outer layers.

The heat sealable film is structurally rigid to prevent stretching and distortion of the film during the heat sealing process and to maintain a rectangular package shape during shipping, handling and display of the bag. The extruded film is designed to have a hot tack (i.e., strength a material has in molten state) which is higher in the inside layer than in the outer layer. A high hot tack enables the inside layer to hold the weight of a product poured into the bag during filling.

The two side walls are folded inwardly between the front and rear walls to form vertical gussets adjacent to the top portion of the bag and horizontal gussets adjacent to the bottom portion of the bag. The top portion includes a perforation that is torn to open the bag and allow opening of one of the gussets. When one gusset is opened, a spout for pouring out contents of the bag is formed. The perforation can be located in the top right hand corner of the bag, just below the heat seal. The top portion also includes an integral handle which can be cut into the heat sealed area.

The bag can be formed on a Vertical Form, Fill and Seal (VFFS) bag machine. The method for producing the standup bag having front and rear walls, two side walls, a top portion, and a bottom portion upon which the bag stands when filled, comprises the steps of wrapping a single piece of heat sealable film, having top and bottom edges and first and second side edges, around a tube to continuously form the front wall, the two side walls, and the rear wall; heat sealing, without using a cooling medium for controlling temperature of the film, the first and second side edges to each other to close the rear wall; folding the two side walls inwardly between the front and rear walls so as to form gussets in the top portion and the bottom portion; heat sealing, without using a cooling medium for controlling temperature of the film, the bottom edge to seal the bottom portion; filling the bag with a predetermined material; heat sealing, without using a cooling medium for controlling temperature of the film, the top edge to seal the top portion; inserting a perforation in the top portion for opening the bag and to form a spout for pouring out the material in the bag when the bag is opened; and forming an integral handle in the top portion.

BRIEF DESCRIPTION OF THE DRAWINGS

The features and advantages of the invention will become apparent upon review of the following detailed description of the preferred embodiment, taken in conjunction with the following drawings, in which:

FIG. 3 is a right side view of a standup bag according to the preferred embodiment of the present invention;

FIG. 4 is a left side view of a standup bag according to the preferred embodiment of the present invention;

DETAILED DESCRIPTION

Figure 1:
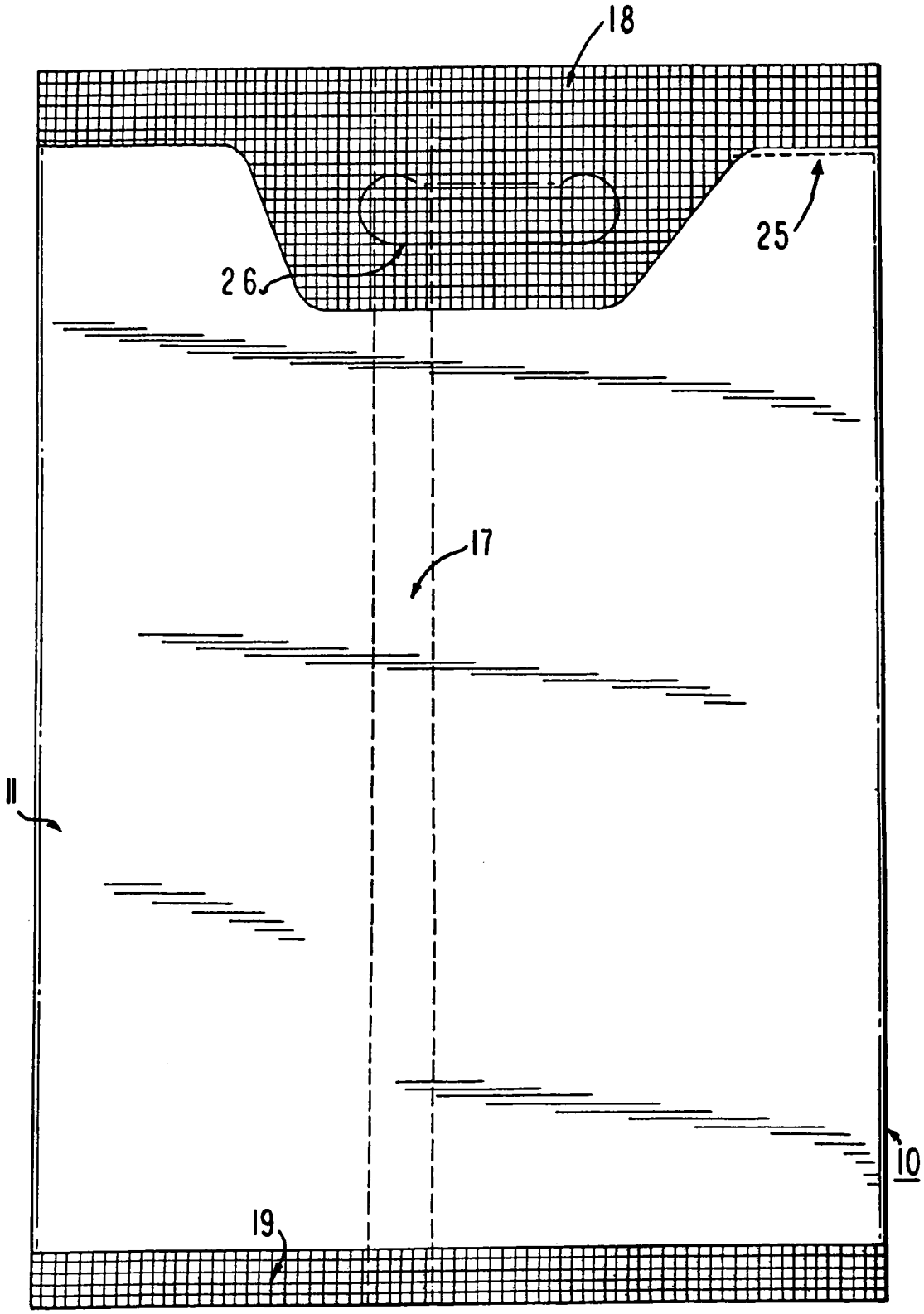
FIG. 1 is a front view of a standup bag according to the preferred embodiment of the present invention.
Figure 2:
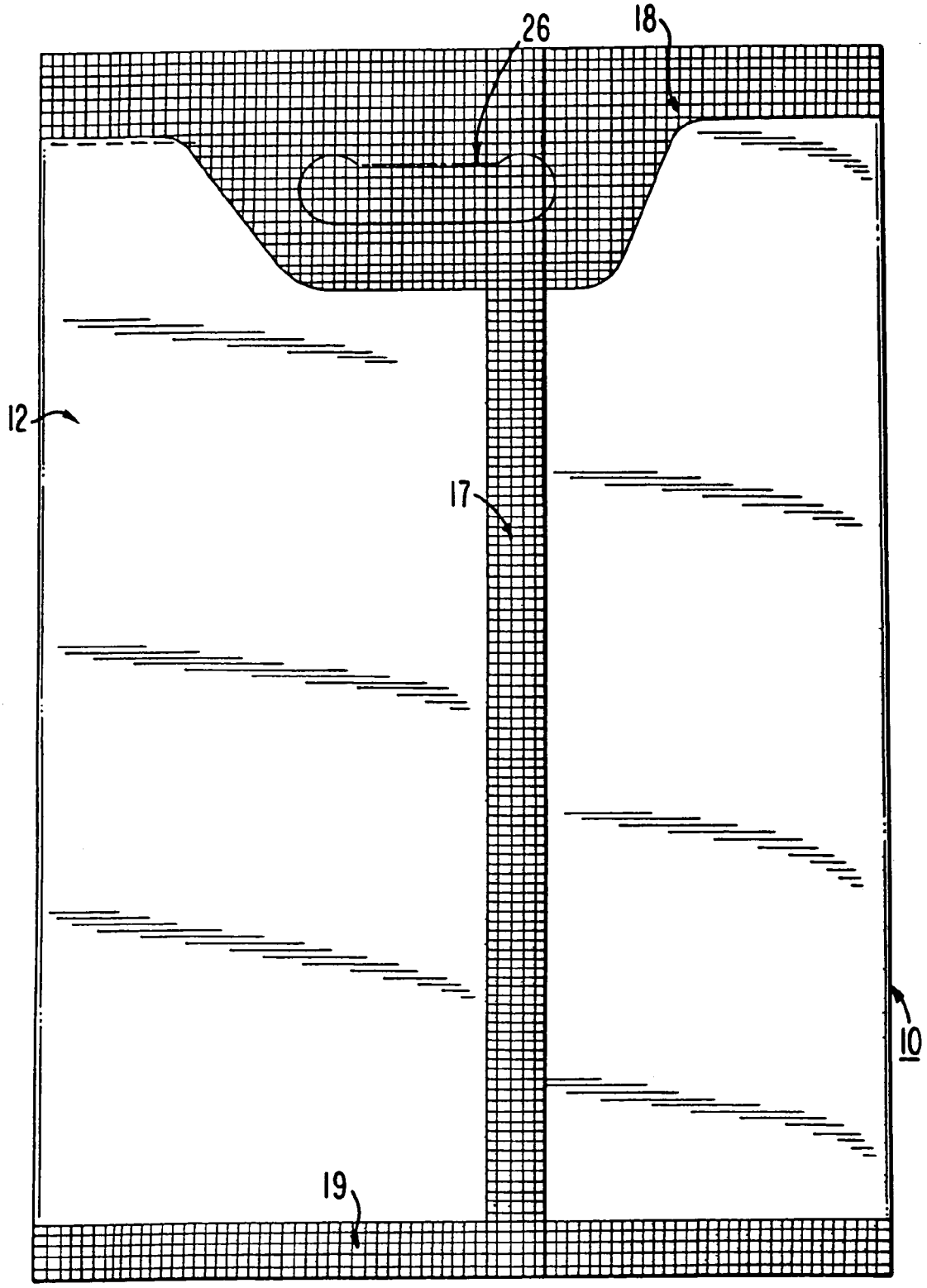
FIG. 2 is a rear view of a standup bag according to the preferred embodiment of the present invention.
Figure 5:
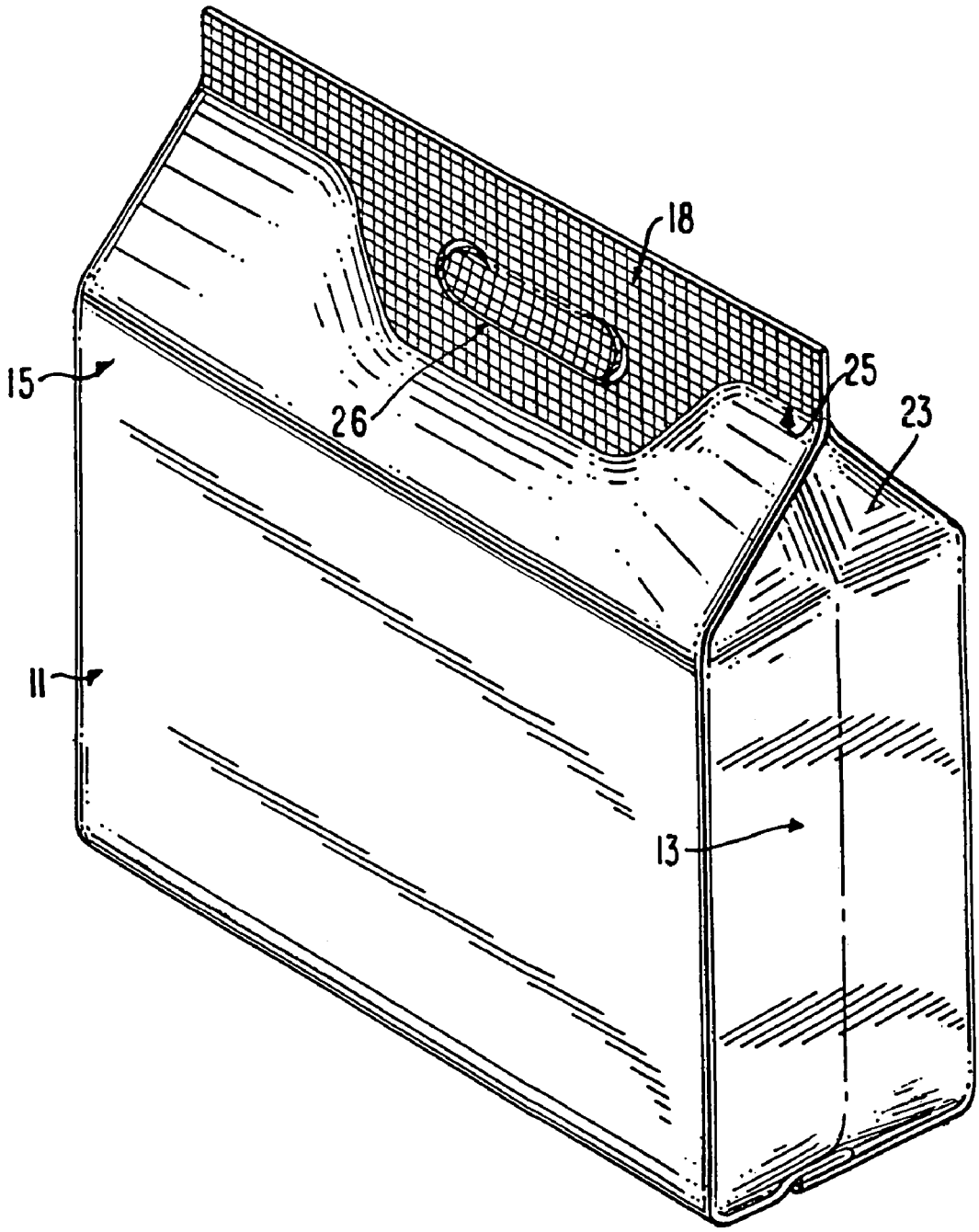
FIG. 5 is a perspective view of a standup bag according to the preferred embodiment of the present invention.

The present invention relates to a standup bag for granular products, such as foods or the like, manufactured from an extruded heat sealable material and having both an integral handle and a perforated section to facilitate opening and pouring out of the contents of the bag.

As shown in FIGS. 1–5, in a preferred embodiment of the present invention, a standup bag 10 includes a front wall 11, a rear wall 12, a side wall 13, a side wall 14, a top portion 15, a bottom portion 16, a vertical heat seal 17 along the rear wall 12, a top portion heat seal 18, a bottom portion heat seal 19, vertical gusset 23 in side wall 13, vertical gusset 24 in side wall 14, a perforation 25 to facilitate opening of the bag 10, and a cut-out handle 26. The top seal 18 and the bottom seal 19 may be corrugated for added beam strength.

The bag 10 can be used to package a variety of consumer products, including frozen vegetables, such as peas, carrots and corn, frozen fruits and meats, popcorn, and the like. The bottom portion 16 folds flat due to horizontal gussets 27, 28, so that the bag 10 is rectangular and can stand upright when filled.

The top portion 15 of the bag is provided with a perforation 25 that can be torn to open the bag 10 and allow opening of one of the gussets 23. When the gusset 23 is opened, a spout for pouring out contents of the bag 10 is formed. The spout permits use of only a portion of the contents without destroying the bag 10 for future use. The perforation 25 can be inserted in the top right hand corner of the bag 10, just below the heat seal 18. The top portion 15 also includes an integral handle 26 which can be cut into or formed in the heat sealed area 18. The handle 26 permits a consumer to carry the bag 10 without getting his or her hands cold when placing the bag 10 in or taking the bag 10 out of a freezer.

Figure 6C:
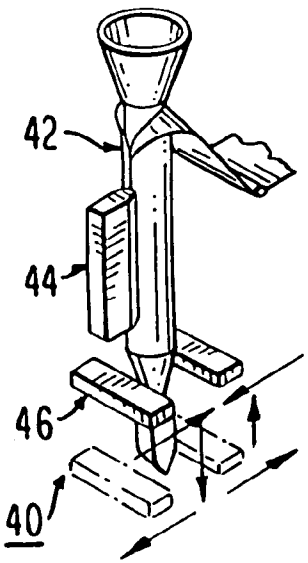
FIGS. 6A–6C are illustrations of a Vertical Form, Fill and Seal bag machine according to the preferred embodiment of the present invention.
Figure 6B:
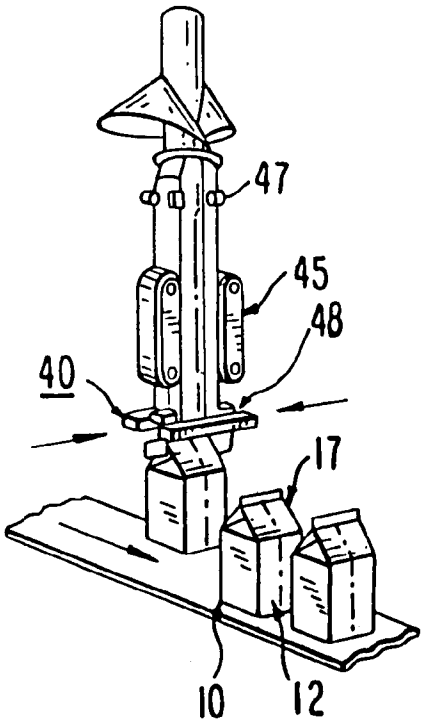
Figure 6A:
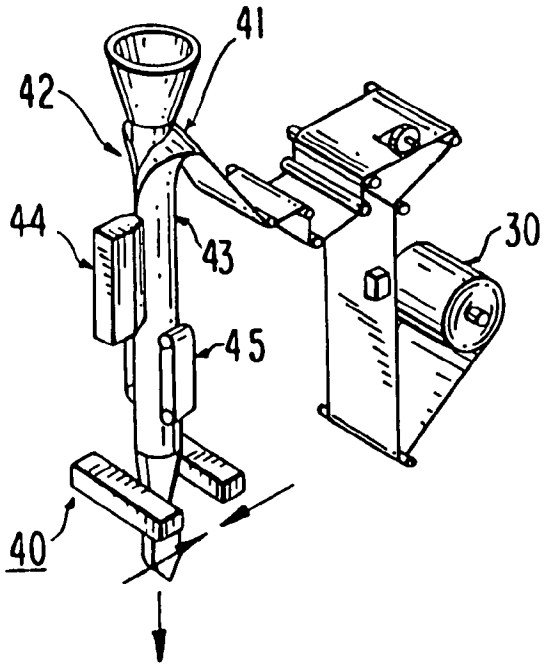

As shown in FIGS. 6A–6C, the bag 10 can be formed on a Vertical Form, Fill and Seal (VFFS) bag machine 40. The bag 10 is made from a heat sealable film 30, which, when cut to a predetermined size, has top and bottom edges and first and second side edges which can be heat sealed to close the bag 10.

The heat sealable film 30 is wrapped around a tube 43 to continuously form the front wall 11, the two side walls 13, 14, and the rear wall 12. The first and second side edges overlap at 42 and the rear wall 12 is sealed by heat sealing the first and second side edges to each other with a reciprocating or continuous back sealer 44. The bottom portion 16 of the bag is sealed by heat sealing the bottom edge with end seal dies 46. Air jets are used to fold the bottom seal forward to provide a flat bottom. The bag 10 is then filled with a predetermined amount of material before heat sealing the top edges with the end seal dies 46. The end seal dies 46 incorporate a cut-off knife to cut the bag 10 to a predetermined size. Gusset tuckers 48 create the gussets 23, 24, 27, 28 by folding the side walls 13, 14 inwardly between the front and rear walls 11, 12.

The bag machine 40 includes a former 41, a feed belt 45, and corner creasers 47. The former 41 enables the heat sealable film 30 to wrap around the tube 43. The feed belt 45 advances the film 30 down the tube 43 and the corner creasers 47 form the edges of the bag, 10 to define the front wall 11, the side walls 13, 14, and the rear wall 12.

Figure 7:
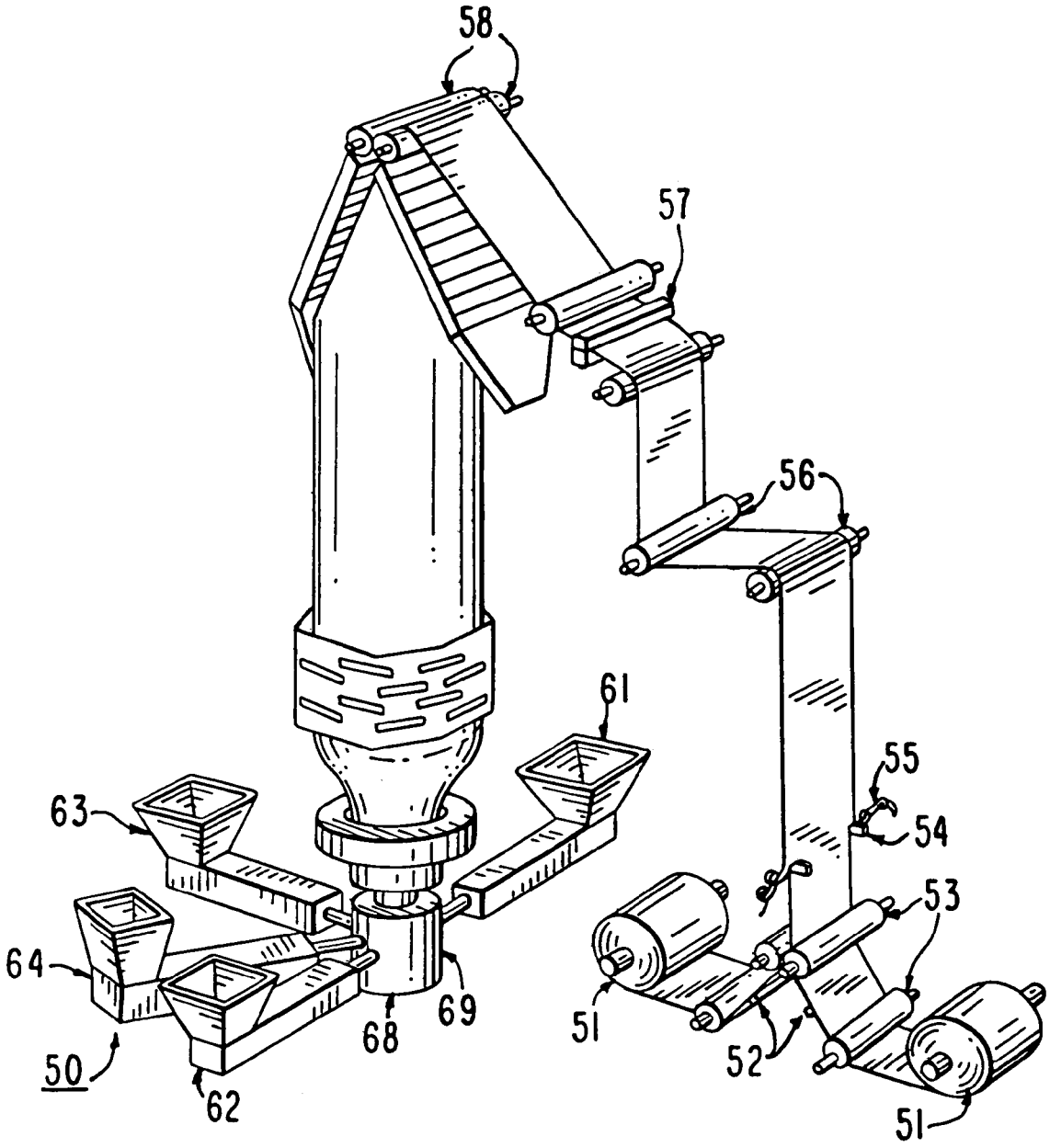
FIG. 7 is an illustration of a multi-layer blown film line according to the preferred embodiment of the present invention.

The heat sealable film 30 is a blown, cast or extruded film that can be extruded or coextruded from various formulations, such as Low Density Polyethylene (LDPE), Linear Low Density Polyethylene (LLDPE), metallocene catalyzed polyolefins, High Density Polyethylene (HDPE), polypropylene, polypropylene co-polymers, polyethylene co-polymers, or blends of the LDPE, LLDPE, metallocene catalyzed polyolefins, HDPE resins, polypropylene, polypropylene co-polymers, and polyethylene co-polymers in combination with coatings, to yield a multi-layer film. Of course, other suitable packaging materials also may be used. The material also may be biodegradable. As shown in FIG. 7, the film 30 can be coextruded on a multi-layer blown film line 50. The film 30 can also be extruded as a single layer on the blown film line 50.

Figure 9:
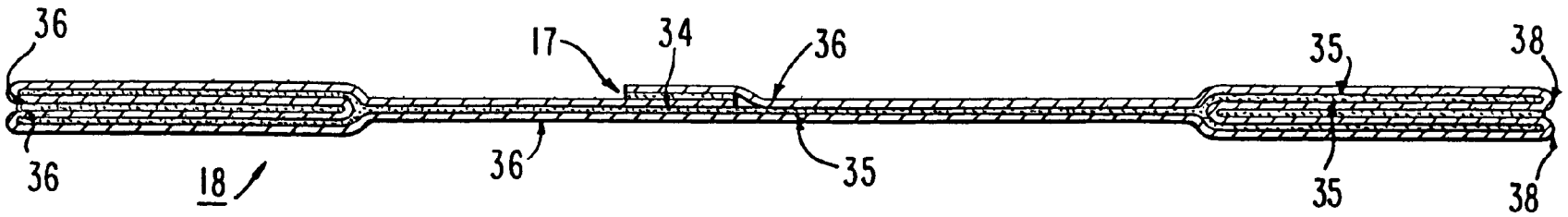
FIG. 9 is a top cross-sectional view of the top portion of a standup bag according to the preferred embodiment of the present invention.

The composition of the film 30 allows for continuous sealing with sealing jaws, for example, the end seal dies 46, without using a cooling medium to control the temperature of the film. Thus, faster production rates are possible. The heat sealable film 30 is manufactured with an inside layer that has a lower seal initiation temperature than the outer layer. As shown in FIG. 9, the inside layer 35 is sealed to itself at the sealing area 34. Heat must be applied to the outer layer 36 at a temperature higher than the melting point of the inside layer 35. The heat must be applied at or above the melting point of the outer layer 36 to seal ear sections 38, 39, but below the temperature at which the outer layer 36 is destroyed.

The film 30 is structurally rigid and puncture-resistant to prevent stretching and distorting the film 30 during the heat sealing process and to maintain a rectangular package shape during shipping, handling and display of the bag 10. The extruded film 30 is designed to have a hot tack which is higher in the inner layer than in the outer layer. A high hot tack enables molten inside layers to hold the weight of a product poured into the bag 10 during filling. A low hot tack in the outer layer 36 prevents sealing jaws from sticking to the outer layer 36.

Due to the varying properties of the different layers, the heat sealing mechanisms, for example, the reciprocating back seal 44 and the end seal dies 46, previously used with only laminated film can now be used with non-laminated coextruded heat sealable film 30. A cooling medium to control the temperature of the film 30 is not required.

Figure 8:
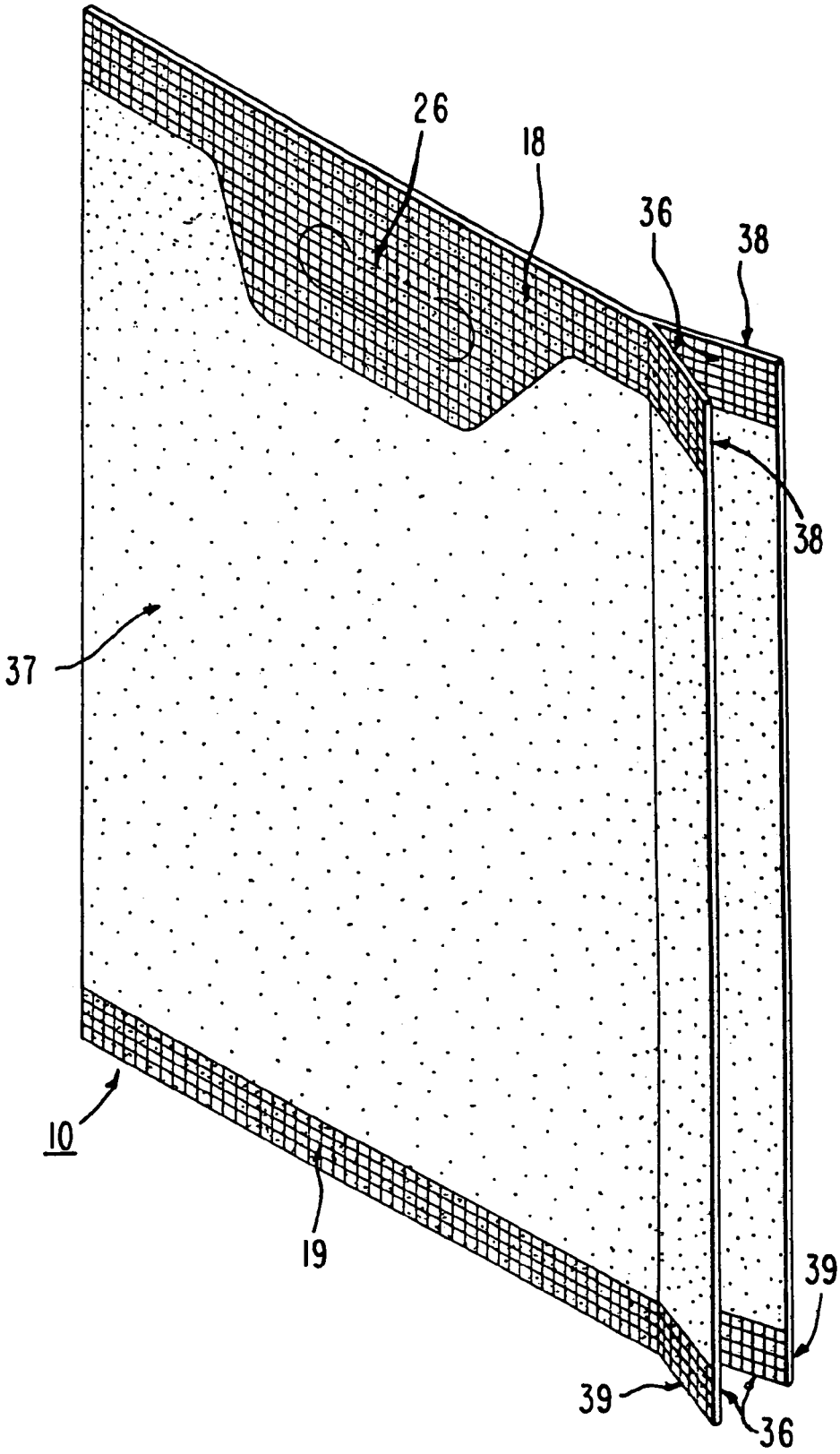
FIG. 8 is a perspective view of a standup bag according to the preferred embodiment of the present invention.

The film 30 can be opaque or clear, and may or may not include heat resistant ink 37 on its outer layer 36. As shown in FIGS. 8 and 9, heat resistant ink 37 may be applied in a pattern, leaving no ink between ear sections 38, 39 of a bag 10. The lack of ink in these areas allows the outer layers 36 of each ear section 38, 39 to be more effectively sealed to each other. The ear sections 38, 39 are portions of the top and bottom edges 18, 19 running from the right or left side walls of the bag 10 toward the center. As shown in FIGS. 8 and 9, the inner layers 35 of each ear section 38, 39 are sealed to each other, and the outer layers 36 can also be sealed to each other if no ink has been applied to these outer layers 36.

In one embodiment of a method for making a bag, using a three-layer film, the film line 50 begins with various formulations of LDPE, LLDPE, HDPE, or blends of the LDPE, LLDPE, and HDPE resins which are coextruded from a middle layer extruder 61, an outer layer extruder 62 and an inner layer extruder 63. Extruder 64 is not used with a three-layer film. Any suitable number of layers can be extruded. For example, a single extruder may be used for a single layer film and two extruders may be used to create a two-layer film. The layers are brought together utilizing a rotator 68 and a mixer adaptor 69. The resulting film 30 is advanced by rotating primary nip rolls 58, idler rolls 56 and secondary nip rolls 53. As the film 30 advances beyond the idler rolls 56, it is trimmed by a slitter 54, with excess material 55 falling away. The film 30 is wound into rolls 51 and the surface tension modified by treaters 57 and 52 on its inside and/or outside surfaces, respectively.

The preferred embodiments and methods described above are illustrative of the invention, which is not limited to the embodiment and methods described. Various changes and modifications may be made in the invention by one skilled in the art without departing from the spirit or scope of the invention.

What is claimed is:

1. A method for manufacturing from a single piece of film, a bag having front and rear walls, two side walls, a top portion, and a bottom portion upon which the bag stands when filled, comprising the steps of:

wrapping a heat sealable film, having top and bottom edges and first and second side edges, around a tube to continuously form the front wall, the two side walls, and the rear wall;

heat sealing, without using a cooling medium for controlling temperature of the film, the first and second side edges to each other to close the rear wall;

heat sealing and folding, without using a cooling medium for controlling temperature of the film, the bottom edge to seal the bottom portion;

filling the bag with a predetermined material;

folding the two side walls inwardly between the front and rear walls so as to form gussets in the top portion and the bottom portion;

heat sealing, without using a cooling medium for controlling temperature of the film, the top edge to seal the top portion; and coating the heat sealable film with heat resistant ink on an outer layer of the heat sealable film.

2. The method according to claim 1, wherein the heat resistant ink is applied in a pattern, leaving no ink between sections forming ears on the bag.

3. The method according to claim 1, wherein the heat sealable film has an inside layer and an outer layer, the inside layer having a higher hot tack than the outer layer.

4. The method according to claim 1, further comprising the step of coextruding the heat sealable film on a multi-layer blown film line.

5. The method according to claim 1, wherein the bag is formed on a vertical form, fill and seal bag machine.

6. The method according to claim 1, wherein the a perforation is inserted below the top edge heat seal.

7. The method according to claim 1, wherein a handle is formed in the top edge heat seal.

8. The method according to claim 1, wherein the gussets in the top portion are vertical.

9. The method according to claim 1, wherein the gussets in the top portion are horizontal.

10. The method according to claim 1, further comprising the step of extruding the heat sealable film from a group consisting essentially of Low Density Polyethylene (LDPE), Linear Low Density Polyethylene (LLDPE), metallocene catalyzed polyolefins, High Density Polyethylene (HDPE), polypropylene, polypropylene co-polymers, polyethylene co-polymers, or blends of the LDPE, LLDPE, metallocene catalyzed polyolefins, HDPE, polypropylene, polypropylene co-polymers, and polyethylene co-polymers.

11. The method according to claim 1, wherein the heat sealable film is extruded and non-laminated.

12. The method according to claim 1, wherein the heat sealable film is not printed.

13. The method according to claim 1, wherein the heat sealable film is a multi-layer film.

14. The method according to claim 1, wherein the heat sealable film is sealed with heat sealing jaws.

15. The method according to claim 1, wherein the heat sealable film is structurally rigid.

16. The method according to claim 1, wherein the heat sealable film has an inside layer and an outside layer, the inside layer having a lower seal initiation point than the outer layer.

17. The method according to claim 1, further comprising the step of forming an integral handle along a predetermined pattern.

18. The method according to claim 17, wherein the predetermined pattern is substantially an oval or circle.

19. The method according to claim 1, further comprising the steps of simultaneously heat sealing the top portion of the bag, heat sealing the bottom portion of a next adjacent bag, forming a handle in the top portion of the bag, and displacing the bag from the next adjacent bag.

20. The method according to claim 1, further comprising the step of cutting a perforation into the bag with a cutting edge.

21. The method according to claim 1, further comprising the step of cutting a handle in a sealing area.

22. A method for manufacturing from a single piece of film, a bag having front and rear walls, two side walls, a top portion, and a bottom portion upon which the bag stands when filled, comprising the steps of:

wrapping a heat sealable film, having top and bottom edges and first and second side edges, around a tube to continuously form the front wall, the two side walls, and the rear wall;

heat sealing with heat sealing jaws, without using a cooling medium for controlling temperature of the film, the first and second side edges to each other to close the rear wall;

heat sealing with heat sealing jaws and folding, without using a cooling medium for controlling temperature of the film, the bottom edge to seal the bottom portion;

filling the bag with a predetermined material;

folding the two side walls inwardly between the front and rear walls so as to form gussets in the top portion and the bottom portion;

heat sealing with heat sealing jaws, without using a cooling medium for controlling temperature of the film, the to edge to seal the top portion; and coating the heat sealable film with an overcoating on an outer layer of the heat sealable film.

23. The method according to claim 22, further comprising the step of applying the overcoating over all areas of the bag that contact the heat sealing jaws.

24. The method according to claim 22, further comprising the step of forming an integral handle along a predetermined pattern.

25. The method according to claim 24, wherein the predetermined pattern is substantially an oval or circle.

26. The method according to claim 22, further comprising the steps of simultaneously heat sealing the top portion of the bag, heat sealing the bottom portion of a next adjacent bag, forming a handle in the top portion of the bag, and displacing the bag from the next adjacent bag.

27. The method according to claim 22, further comprising the step of cutting a perforation into the bag with a cutting edge.

28. The method according to claim 22, further comprising the step of cutting a handle in a sealing area.

29. The method according to claim 22, further comprising the step of extruding the heat sealable film from a group consisting essentially of Low Density Polyethylene (LDPE), Linear Low Density Polyethylene (LLDPE), metallocene catalyzed polyolefins, High Density Polyethylene (HDPE), polypropylene, polypropylene co-polymers, polyethylene co-polymers, or blends of the LDPE, LLDPE, metallocene catalyzed polyolefins, HDPE, polypropylene, polypropylene co-polymers, and polyethylene co-polymers.

30. The method according to claim 22, wherein the heat sealable film is extruded and non-laminated.

31. The method according to claim 22, wherein the heat sealable film is not printed.

32. The method according to claim 22, wherein the heat sealable film is a multi-layer film.

33. The method according to claim 22, wherein the heat sealable film is structurally rigid.

34. The method according to claim 22, wherein the heat sealable film has an inside layer and an outside layer, the inside layer having a lower seal initiation point than the outer layer.

35. The method according to claim 22, wherein the overcoating is applied in a pattern, leaving no overcoating between sections forming ears on the bag.

36. The method according to claim 22, wherein the heat sealable film has an inside layer and an outer layer, the inside layer having a higher hot tack than the outer layer.

37. The method according to claim 22, further comprising the step of coextruding the heat sealable film on a multi-layer blown film line.

38. The method according to claim 22, wherein the bag is formed on a vertical form, fill and seal bag machine.

39. The method according to claim 22, wherein a perforation is inserted below the top edge heat seal.

40. The method according to claim 22, wherein a handle is formed in the top edge heat seal.

41. The method according to claim 22, wherein the gussets in the top portion are vertical.

42. The method according to claim 22, wherein the gussets in the top portion are horizontal.

* * * * *